US010743637B2

(12) United States Patent
Carraro

(10) Patent No.: US 10,743,637 B2
(45) Date of Patent: Aug. 18, 2020

(54) HOUSING FOR COSMETIC PRODUCT

(71) Applicant: ALBEA SERVICES, Gennevilliers (FR)

(72) Inventor: Daniel Carraro, Asnières sur Seine (FR)

(73) Assignee: ALBEA SERVICES, Gennevilliers (FR)

( * ) Notice: Subject to any disclaimer, the term of this patent is extended or adjusted under 35 U.S.C. 154(b) by 86 days.

(21) Appl. No.: 15/360,819

(22) Filed: Nov. 23, 2016

(65) Prior Publication Data

US 2017/0143099 A1 May 25, 2017

(30) Foreign Application Priority Data

Nov. 24, 2015 (FR) ..... 15 61307

(51) Int. Cl.

| | |
|---|---|
| ***A45D 40/24*** | (2006.01) |
| ***A45C 13/10*** | (2006.01) |
| ***A45D 33/20*** | (2006.01) |
| ***A45D 40/22*** | (2006.01) |
| ***A45D 33/00*** | (2006.01) |

(Continued)

(52) U.S. Cl.

CPC ..... *A45D 40/24* (2013.01); *A45C 13/1069* (2013.01); *A45D 33/006* (2013.01); *A45D 33/008* (2013.01); *A45D 33/20* (2013.01); *A45D 40/22* (2013.01); *B65D 25/10* (2013.01); *B65D 43/163* (2013.01); *B65D 43/22* (2013.01); *A45D 2040/227* (2013.01); *A45D 2040/228* (2013.01)

(58) Field of Classification Search

CPC .... A45C 13/1069; A45D 40/24; A45D 40/22; A45D 33/006; A45D 33/008; A45D 33/20; A45D 40/222; A45D 2040/225; B65D 43/22

USPC ..... 206/754, 581

See application file for complete search history.

(56) References Cited

U.S. PATENT DOCUMENTS

| | | | | | |
|---|---|---|---|---|---|
| 2,017,485 | A | * | 10/1935 | Yawman | B25H 3/023 312/266 |
| 2,204,717 | A | * | 6/1940 | Younghusband | A45D 33/28 132/296 |
| 3,410,018 | A | * | 11/1968 | Woolworth | A01K 97/06 206/315.11 |

(Continued)

FOREIGN PATENT DOCUMENTS

| | | |
|---|---|---|
| CN | 104816887 | 8/2015 |
| FR | 3013196 | 5/2015 |

(Continued)

*Primary Examiner* — Steven A. Reynolds

(74) *Attorney, Agent, or Firm* — Steven M. Greenberg, Esq.; Shutts & Bowen LLP

(57) ABSTRACT

A housing for cosmetic product includes a base receiving at least one cosmetic product and a cover mounted on the base so as to be able to rotate, and to be moved between a closed position and an open position. The housing also includes an intermediate plate receiving at least one cosmetic product and mounted on the cover so as to be able to rotate and is arranged between the base and the cover, the plate being movable between a retracted position and a deployed position. The plate passes from the retracted position thereof to the deployed position thereof by a manipulation of the cover. The intermediate plate as well is movable in rotation between the deployed position and a release position in which the plate is led to a distance from the base so as to expose and/or make accessible the entire surface area of the base.

5 Claims, 3 Drawing Sheets

(51) Int. Cl.

| | |
|---|---|
| ***B65D 25/10*** | (2006.01) |
| ***B65D 43/16*** | (2006.01) |
| ***B65D 43/22*** | (2006.01) |

(56) References Cited

U.S. PATENT DOCUMENTS 4,580,586 A * 4/1986 Kitoh ..... A45D 40/22 132/315
4,696,317 A * 9/1987 Shioi ..... A45D 40/22 132/314
5,054,505 A * 10/1991 Yuhara ..... A45D 40/18 132/294
5,638,839 A * 6/1997 Montoli ..... A45D 40/22 132/294
6,283,129 B1 * 9/2001 Yuhara ..... A45C 13/1084 132/293
7,047,983 B2 * 5/2006 Manougian ..... A45D 33/006 132/294
7,089,627 B2 * 8/2006 Seidler ..... B65D 51/04 16/320
7,810,644 B2 * 10/2010 Fraillon ..... A45D 40/24 132/295
8,590,545 B2 * 11/2013 Won ..... A45D 33/008 132/293
9,095,198 B2 * 8/2015 Apodaca ..... A45D 33/006
2004/0244812 A1 * 12/2004 Seidler ..... A45D 40/221 132/301
2005/0194384 A1 * 9/2005 Petit ..... A45C 13/1069 220/230
2007/0108094 A1 * 5/2007 Dieudonat ..... A45D 40/221 206/581
2007/0131240 A1 * 6/2007 Prague ..... A45D 33/22 132/294
2008/0023023 A1 * 1/2008 Boye ..... A45C 11/008 132/294
2008/0257376 A1 * 10/2008 Pires ..... A45D 33/008 132/287
2009/0071502 A1 * 3/2009 Drugeon ..... A45C 13/1069 132/293
2013/0284202 A1 * 10/2013 Limongi ..... A45D 33/008 132/316

FOREIGN PATENT DOCUMENTS

JP S58190908 12/1983
JP S60137906 9/1985

* cited by examiner

HOUSING FOR COSMETIC PRODUCT

CROSS REFERENCE TO RELATED APPLICATIONS

This application claims priority under 35 U.S.C. § 119(a) to French Patent Application Serial Number 1561307, filed Nov. 24, 2015, entitled "HOUSING FOR COSMETIC PRODUCT", the entire teachings of which are incorporated herein by reference.

BACKGROUND OF THE INVENTION

Field of the Invention

The invention relates to a housing for cosmetic product. Such housings comprise a base having one or more apertures for receiving cosmetic products and a cover which is connected to the base to close or open the housing. Thus, when the cover is in the opening position, the user has access to the apertures in the base.

Description of the Related Art

In order to increase the number of proposed cosmetic products in the housing, it is known to add an intermediate plate, acting as an internal drawer, between the base and the cover. Said intermediate plate can receive cosmetic products, just like the base. It is designed so as to be hidden in the cover when the housing is closed, and deployed relative to the cover when the housing is open so as to be able to access all the cosmetic products at the same time.

The manipulation of the cover drives the movement of the intermediate plate from one position to the other, by means of mechanical connections. For this purpose, the intermediate plate is generally mounted so as to be able to rotate on the cover, for example by means of pins, and slides relative to the base, for example by means of lugs sliding in grooves or recesses hollowed out in the base.

Aside from the fact that mounting the plate is difficult inside the housing, this construction has another major disadvantage. Given the existence of the mechanical connection between the plate and the base, the plate cannot be completely removed from the base, and thus hides some of the apertures inside the base. Said apertures are thus not accessible. The utilisation of the space in the base under the plate is very limited. In addition, the design of the different parts is relatively complicated, since it must integrate the mechanical connections. This leads to expensive and fragile moulds.

BRIEF SUMMARY OF THE INVENTION

The present invention remedies the different disadvantages set out above, by means of a housing which makes it possible to provide, for external dimensions which are similar to those of a housing from the prior art, more internal space which is easily accessible for cosmetic products, having a simplified design for all the parts, and which also provides additional functionalities which make it possible to facilitate the actions of opening and closing the housing. In particular, a housing is described herein for a cosmetic product that includes:

a base receiving at least one cosmetic product;

a cover which is mounted on the base so as to be able to rotate, and being movable between a position for closing the housing, which is referred to as the closed position, and a position for opening the housing, which is referred to as the open position;

an intermediate plate receiving at least one cosmetic product, which plate is mounted on the cover so as to be able to rotate, and is arranged between the base and the cover, said plate being movable between a retracted position, in which said plate covers the base when the cover is closed, and a deployed position, in which said plate is set back relative to the base when the cover is open so as to make the cosmetic product at least partially accessible from the base, the plate passing from the retracted position thereof to the deployed position thereof by a manipulation of the cover.

The device is primarily characterised in that the intermediate plate is also movable in rotation between said deployed position and a release position in which said plate is led to a distance from the base so as to expose and/or make accessible the entire surface area of the base. The intermediate plate is thus movable between three successive positions: the retracted position, the deployed position, and the release position.

Thus, as one aspect of the invention, an intermediate plate is provided which can receive cosmetic products, and which can be completely released from the base so that the entire surface area of the base is accessible and can receive cosmetic products. This thus makes it possible to increase the capacity for storing cosmetic products in the housing. Said release position of the intermediate plate also makes it possible to have access to almost the entire internal surface area of the cover (except for the region in which the plate is fixed), which was not possible in the prior art. It is for example possible to provide two different mirrors (one normal and the other having enlarging magnifying effect) which are located on both sides of the region for fixing the plate. These two mirrors thus cover the entire internal surface area of the cover, the mirror located below the fixing region being accessible when the intermediate plate is in the release position.

As well, between the retracted position and the deployed position, the plate slides relative to the base, and rotates relative to the cover, as is known in the prior art. In order to promote this sliding movement and render it partly automatic during the manipulation of the cover, the housing comprises means for assisting in opening the cover and holding it in the open position, as well as means for assisting in closing the cover and holding it in the closed position. Thus, when the user manually starts an opening movement of the housing, the plate will slide automatically from the retracted position thereof to the deployed position thereof. Inversely, when the user manually starts a closing movement of the housing, the plate will slide automatically from the deployed position thereof to the retracted position thereof. The sliding is thus an assisted sliding following a starting action which is manually initiated by the user.

Even further, holding the cover in the open position is relatively convenient, in particular when the cover contains a mirror, since this allows the user to apply make-up in front of the mirror without needing to hold the cover. More specifically, the means for assisting in opening the cover and holding it in the open position and the means for assisting in closing the cover and holding it in the closed position consist of magnetic devices. The sliding of the plate is thus directed by magnetic attraction forces. The use of magnetic devices is particularly advantageous because it dispenses with any bulky mechanical connections, which are difficult to implement, and are subject to problems in terms of wear in particular, and thus in terms of mechanical strength over time. The construction of the plate and of the base is thus simpler and more refined. The assembly thereof inside the housing is also facilitated.

Of note, in order to be able to pass from the deployed position to the release position, the plate must be able to be completely separated from the base after the sliding thereof. By using magnetic devices for the sliding of the plate, it is easy to manually terminate the magnetic attraction forces which are exerted between the plate and the base, in order to the position the plate in the release position. Specifically, each magnetic device includes at least one part which is attached to the intermediate plate, and at least one part which is attached to the base, said two parts cooperating magnetically with one another according to the position of the intermediate plate relative to the base. When the two parts move closer together following a manual action by the user, as soon as one of the parts enters the magnetic field of the other, a magnetic attraction is created between the two parts, which causes the automatic displacement of the plate relative to the base.

As well, for each magnetic device, at least one of the two parts is made of a magnetic material such as a magnet for example. The other part can also be made of a magnetic material, or of a ferromagnetic material, or also of a metal material. For each magnetic device, said two parts are arranged on the same lateral side of the housing which is oriented perpendicularly to the axes of rotation of the cover and of the intermediate plate. Since the object is for the parts to attract one another so as to be superimposed one on top of the other, it is necessary for said parts to be aligned on the same side.

Generally, the base, the cover and the intermediate plate each have a rear portion which is located in the vicinity of the axes of rotation of the cover and of the intermediate plate, as well as a front portion which is located opposite the rear portion. These terms "front" and "rear" are defined in relation to a manipulation and a nominal use of the housing, i.e. when the housing is closed and placed horizontally on a work surface, or in the hand of a user. The base is placed on the work surface or the hand, and the user views the cover of the closed housing and "the front" of the housing in a general manner.

According to the invention, the magnetic device for assisting in opening the cover and holding it in the open position comprises a first part which is arranged in the rear portion of the base in the region of a first lateral side of the housing, and a second part which is arranged in the front portion of the intermediate plate in the region of the same first lateral side of the housing, the two parts being arranged so as to be superimposed one on top of the other in the open position of the cover. Thus, the two parts are sufficiently far apart from one another in the closed position of the cover that they are not attracted by one another. When the user starts to open the cover, the plate starts to slide, and the second part starts to move closer to the first part, until one of said parts exerts the magnetic attraction power thereof on the other and automatically then leads to the sliding of the plate without any additional manual action.

The two parts of the magnetic device for assisting in opening the cover and holding it in the open position consist of two magnets exerting a magnetic attraction force on one another. Since the force required to open the housing is significant, it is preferable for there to be two magnets, thus having significant magnetic forces. According to a first possible configuration, the magnetic device for assisting in closing the cover and holding it in the closed position comprises a first part which is arranged in the front portion of the base in the region of a second lateral side of the housing, and a second part which is arranged in the rear portion of the intermediate plate in the region of the same second lateral side of the housing, the two parts being arranged so as to be superimposed one on top of the other in the closed position of the cover.

In this case, the first lateral side of the housing is used for the opening thereof, and the second lateral side is used for the closing thereof. In the same manner as previously, the two parts are sufficiently far apart from one another in the open position of the cover that they are not attracted by one another. When the user starts to close the cover, the plate starts to slide, and the second part starts to move closer to the first part, until one of said parts exerts the magnetic attraction power thereof on the other and automatically then leads to the sliding of the plate without any additional manual action.

The two parts of the magnetic device for assisting in closing the cover and holding it in the closed position consist of two magnets exerting a magnetic attraction force on one another. Since the force required to ensure this function of closing the housing is less than that required to ensure the opening function, it would also be conceivable to provide a magnet and a metal part instead of two magnets.

According to a second possible configuration, the magnetic device for assisting in closing the cover and holding it in the closed position comprises a first part which is arranged in the front portion of the base in the region of the first lateral side of the housing, and a second part which is arranged in the front portion of the intermediate plate in the region of the same first lateral side of the housing, the two parts being arranged so as to be superimposed one on top of the other in the open position of the cover.

In this case, the first lateral side is used both for the opening and for the closing of the housing. The two magnetic devices are then arranged in the same side, the other side being able to remain neutral. As explained above, when the user starts to close the cover, the plate starts to slide, and the second part starts to move closer to the first part, until one of said parts exerts the magnetic attraction power thereof on the other and automatically then leads to the sliding of the plate without any additional manual action.

In order for this second configuration to work, in other words, in order for there to be no interference between the two magnetic devices, it is necessary for the second part of the magnetic device for assisting in closing the cover and holding it in the closed position to be coincident with the second part of the magnetic device for assisting in opening the cover and holding it in the open position. There is thus one single part in the plate which acts successively with the two parts contained in the base according to the actions of opening and closing the housing.

Preferably, in the magnetic device for assisting in closing the cover and holding it in the closed position, the first part consists of a metal plate and the second part consists of a magnet which is capable of exerting a magnetic attraction force on said metal plate.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 12:
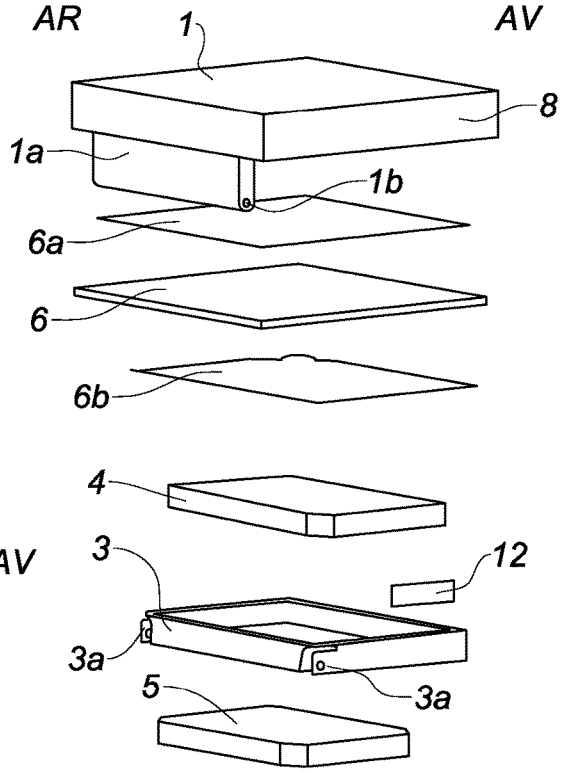
FIG. 12 is an exploded perspective view of the housing according to the second configuration of the invention.
Figure 12:
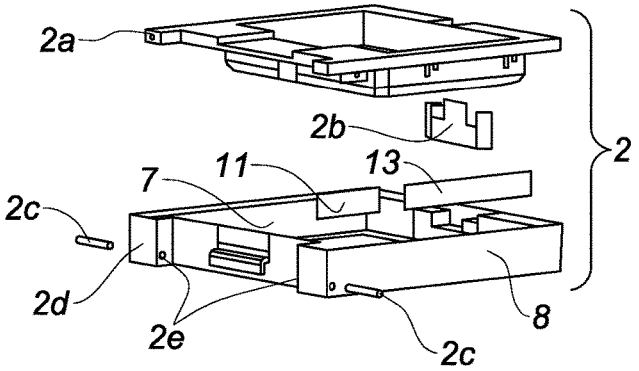

In an embodiment of the invention, and in reference to FIG. 12, a housing includes:

a base 2 with a parallelepipedal appearance, comprising a support 2*a* defining a central cavity in which a cup 2*a* which is cable of receiving a cosmetic product 5 is inserted;

a cover 1 with a parallelepipedal appearance and dimensions similar to those of the base 2, which is mounted so as to be able to rotate on the base 2 by means of journals 2*c* which are inserted in openings 2*e*, 1*b* which are provided for this purpose both on the base 2 and on a fastening tab 1*a* extending from the cover 1 towards the base 2;

a mirror 2 which is glued inside the cover 2 in the region of the bottom thereof, by means of a piece of double-sided adhesive tape 6*a* and protected by an external protective film 6*b;* an intermediate plate 3 with a parallelepipedal appearance and dimensions which are slightly less than those of the base 2 and of the cover 1, defining a central cavity which is capable of receiving a cosmetic product 4, and which is mounted so as to be able to rotate on the cover 1 by means of two cylindrical assembly pins 3*a* which are accommodated in two holes (not shown) which are provided for this purpose in the cover 1;

a hook 2*b* belonging to the base 2 and inserted between the support 2*d* and the cup 2*a*, said hook 2*b* being provided to resiliently engage with an edge of the cover 1 so as to lock the cover 1 to the base 2 when the housing is closed.

When the housing is closed and placed horizontally, ready to be used, the housing includes:

an upper face corresponding to the upper surface of the cover 1, a lower face corresponding to the lower surface of the base 2, two lateral sides 7, 8 belonging both to the cover 1 and to the base 2, a first end corresponding to a front face comprising the hook 2*b*, and belonging both to the cover 1 and to the base 2, a second end opposite the first end and corresponding to a rear face where the journals 2*c* and the openings 2*e* and 1*b* are located, and belonging both to the cover 1 and to the base 2.

The front face of the housing is directed towards the users when they carry the housing in their hand in order to use it. In order to better mark the orientation of the housing with the front and rear faces thereof in the different configurations of the housing, the reference sign AR is written on each drawing to mark the rear face, and the reference sign AV is written on each drawing to mark the front face of the housing.

Figure 1:
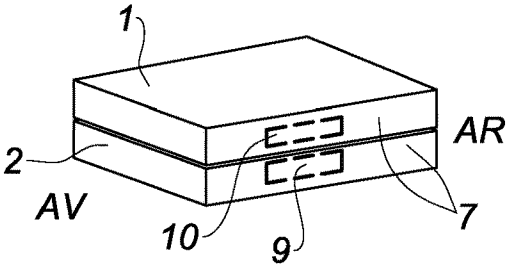
FIG. 1 to 3 are perspective views of a first side of the housing according to a first configuration of the invention during different steps for opening and closing the housing.
Figure 2:
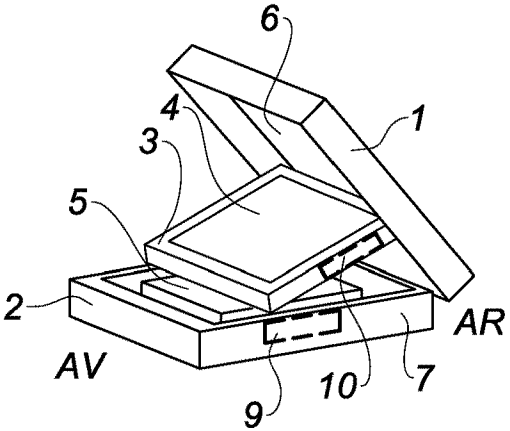
Figure 9:
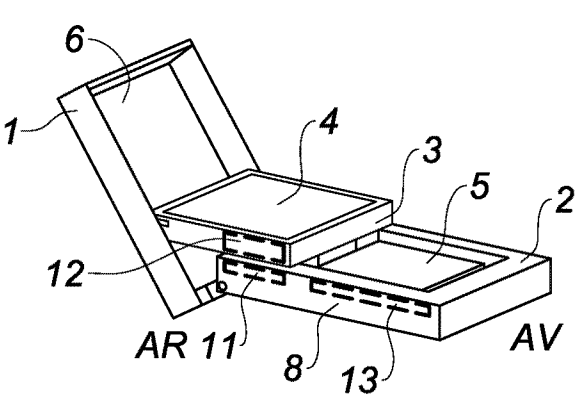
FIG. 8 to 10 are perspective views of the second side of the housing according to a second configuration of the invention during different steps for opening and closing the housing.
Figure 10:
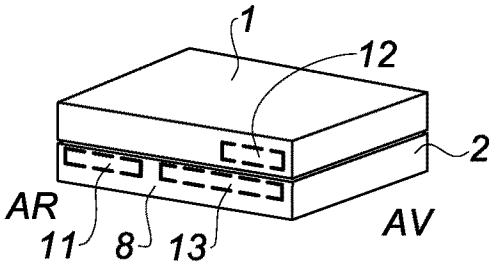
Figure 8:
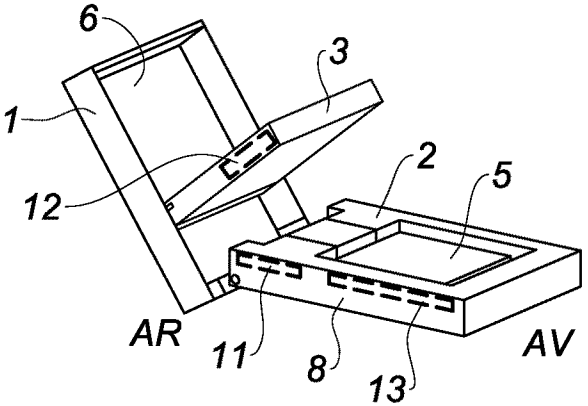

More generally, the base 2, the cover 1 and the intermediate plate 3 each comprise a front portion which is located in the vicinity of the front face of the housing and a rear portion which is located in the vicinity of the rear face of the housing. The cover 1 can be moved relative to the base 2 between a position for closing the housing, which is referred to as the closed position, shown in FIGS. 1, 6 and 10, and a position for opening the housing, which is referred to as the open position, shown in FIGS. 3, 4 and 9. FIGS. 2 and 5 show an intermediate position of the cover 1, during the passage from the open position to the closed position (and vice versa) of the housing.

As stated previously, the cover 1 is mounted so as to be able to rotate relative to the base 2. The journals 2*c* and the openings 2*e* and 1*b* are located in the region of the rear face of the housing, and the cover 1 thus rotates about an axis X which is directed in parallel with the rear face. The cosmetic products 5, 4 arranged in the base 2 and in the intermediate plate 3 are superimposed on one another in the closed position of the cover 1. Said products are exposed and/or made accessible by a first manipulation of the cover 1 as shown in FIG. 1 to 6.

Figure 3:
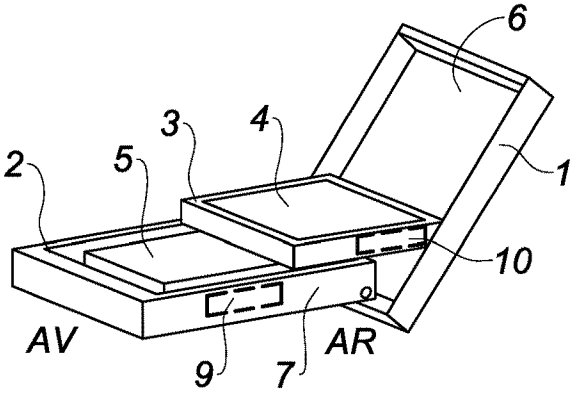

According to an aspect of the invention, the housing is configured so as to expose and/or make accessible all the cosmetic product 5 which is contained in the base 2 by a second manipulation of the intermediate plate 3. During the first manipulation of the cover 1 which is shown in FIG. 1 to 3, said cover passes from the closed position thereof (FIG. 1) to an intermediate position (FIG. 2) then to the open position thereof (FIG. 3). During the first manipulation, the cover 1 drives the intermediate plate 3 to move from a retracted position in which it completely covers the cosmetic product 5 contained in the base 2 (FIG. 1) to a deployed position (FIG. 3) in which it exposes and/or makes partially accessible the cosmetic product 5. The rear portion of the cosmetic product 5 is not accessible and is hidden under the intermediate plate 3.

Figure 4:
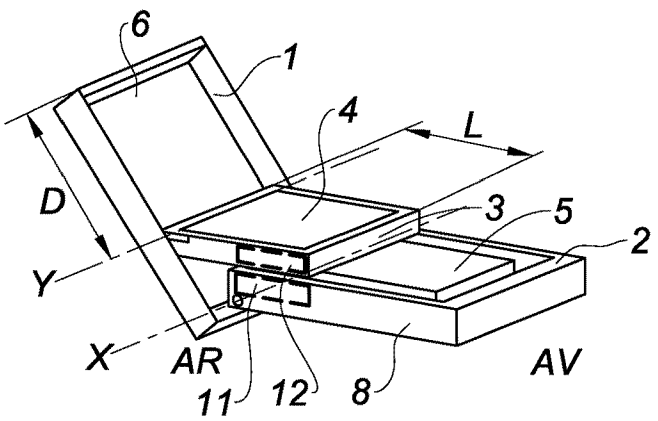
FIG. 4 to 6 are perspective views of a second side of the housing according to the first configuration of the invention during different steps for opening and closing the housing.
Figure 5:
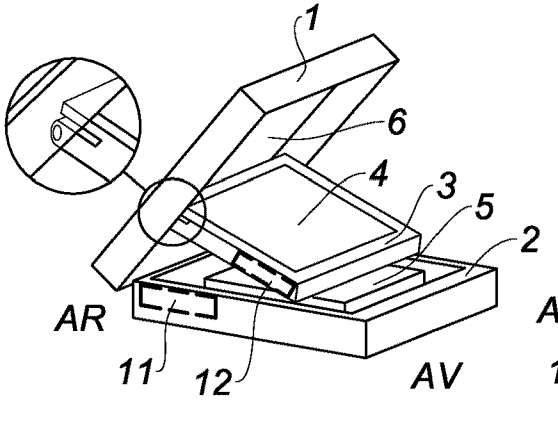

In this case, the intermediate plate 3 is mounted so as to be able to rotate relative to the cover 3, as stipulated previously, about an axis of rotation Y as shown in FIG. 4. The axis Y is parallel to the axis X. The assembly pins 3*a* are provided in the rear portion of the intermediate plate, and the holes are provided in the lateral sides of the cover, at a predefined distance D relative to the front face of the cover 1. Said distance D is greater than the length L of the intermediate plate 3, that is to say the dimension of the plate 3 which is perpendicular to the axis Y, in such a way that the plate 3 can be put away completely inside the cover 1 when the housing is closed.

It can be noted that, in this case, the housing is configured so that the cosmetic product 5 remains stationary during the manipulation. In other words, when the intermediate plate 3 passes from the retracted position thereof to the deployed position thereof, the cosmetic product 5 does not move, since the base 2 does not move.

The intermediate plate 3 is mounted so as to be able to slide relative to the base 2 between the closed position and the position for opening the cover 1. The intermediate plate 3 in fact slides during this first manipulation above the base 2 without driving the base to move. More specifically, the front portion of the plate 3 glides over the upper edges of the front, lateral and rear faces of the base 2.

Figure 7:
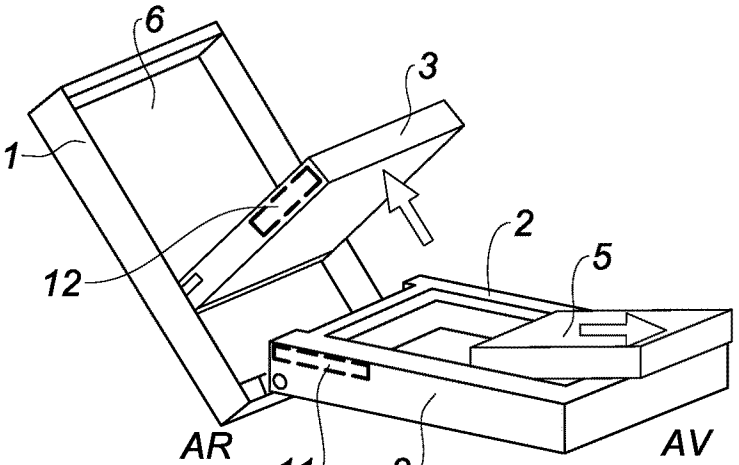
FIG. 7 shows the release position of the intermediate plate.

Once the intermediate plate 3 has arrived in the first deployed position thereof (FIG. 3), the intermediate plate 3 is arranged so as to be lead to a distance from the base 2 by pivoting about the axis Y, in particular by means of a second manipulation of the intermediate plate 3, so as to completely expose the cosmetic product 5 contained in the base 2. The intermediate plate 3 is then located in a release position as shown in FIG. 7. In this case, the portion of the mirror 6 which is located underneath the intermediate plate 3 also becomes accessible to the user.

The mirror 6 can be replaced with one or more other cosmetic products.

In order to close the housing again, the user firstly manipulates the intermediate plate 3 in the opposite direction in such a way that it returns to the deployed position, then manipulates the cover 1 likewise in the opposite direction in such a way that the intermediate plate 3 glides along the base 2 once again as far as the retracted position.

So that the front portion of the intermediate plate 3 remains pressed against the upper edges of the base 2 during the sliding thereof, magnetised devices are integrated in the housing. The magnetised devices include a part in the intermediate plate 3, and a part in the base 2, the two parts cooperating with one another by magnetic attraction, in such a way that the plate 3 is magnetically attracted by the base 2 or vice versa. Thus, during the sliding, the plate 3 will always have a tendency to remain pressed against the base 1. The specific arrangement of these magnetised parts also makes it possible to assist in opening and closing the cover 1, and to hold said cover in the open or closed position.

More specifically, the housing from the invention may include two magnetic devices. A first device is used to assist in opening the housing and holding it in the open position, and a second device is used to assist in closing the housing and holding it in the closed position.

A first embodiment of the invention is shown in FIG. 1 to 7, and a second embodiment is shown in FIG. 8 to 12. The two housing configurations according to the invention differ in the position of the magnetised parts in the housing. The structure of the housing remains the same.

Figure 6:
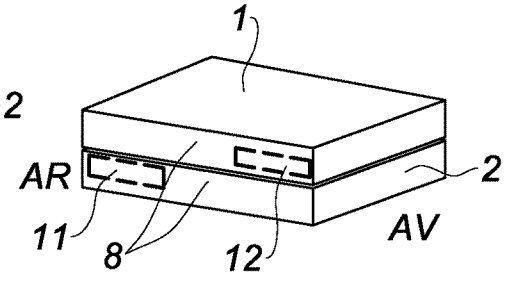

According to the first possible embodiment of the invention, the first magnetic device is composed of a first part 11 which is arranged in the rear portion of the base 2, and of a second part 12 which is arranged in the front portion of the plate 3, the two parts 11, 12 being located in the region of a lateral side 8 of the housing, and visible in FIG. 4 to 6.

Thus, when the housing is closed (FIG. 6), the two parts 11, 12 are at a distance from one another. When the user starts to open the cover, the part 12 moves closer to the part 11 until said parts mutually attract one another (FIG. 5). The front portion of the plate 3 thus remains firmly pressed against the base 2 because the part 12 is attracted by the part 11 until the two parts 11, 12 are superimposed (FIG. 4). Between FIG. 5 and FIG. 4, the user no longer needs to manipulate the cover to end the opening, as it is the attraction force between the parts 11, 12 which causes the movement of the cover 1 towards the open position. The opening is thus assisted by means of the parts 11 and 12. The cover 1 is then held in the open position by means of the two superimposed parts 11, 12.

The user can manually terminate this magnetic attraction in order to raise the plate 3 towards the release position thereof as shown in FIG. 7.

The second magnetic device is composed of a first part 9 which is arranged in the front portion of the base 2, and of a second part 10 which is arranged in the rear portion of the plate 3, the two parts 9, 10 being located in the region of another lateral side 7 of the housing, and visible in FIG. 1 to 3.

Thus, when the housing is open (FIG. 3), the two parts 9, 10 are at a distance from one another. When the user starts to close the cover, the part 10 moves closer to the part 9 until said parts mutually attract one another (FIG. 2), and this has the effect of then causing the movement of the cover 1 without any additional intervention on the part of the user. With the cover 1 then closed, the two parts 9, 10 are superimposed (FIG. 1). The closing is thus assisted by means of the parts 9 and 10. The cover 1 is then held in the closed position by means of the two superimposed parts 11, 12. The parts 9, 10, 11, 12 are for example all magnets which attract one another in pairs on the same lateral side of the housing.

According to a second embodiment of the invention, it is possible to simplify these magnetic devices by combining the magnetic devices. Thus, as previously, the first magnetic device is composed of a first part 11 which is arranged in the rear portion of the base 2, and of a second part 12 which is arranged in the front portion of the plate 3, the two parts 11, 12 being located in the region of a lateral side 8 of the housing, and visible in FIG. 8 to 10.

By contrast, the second magnetic device is composed of a first part 13 which is arranged in the front portion of the base 2, and cooperates with the second part 12 which is arranged in the front portion of the plate 3, the two parts 13, 12 being located in the region of the same lateral side 8 of the housing.

In this case, there are only three parts 11, 12, 13 for the two magnetic devices, one part 12 being common to the two devices, and all the parts 11, 12, 13 being located on the same lateral side 8. The other side 7 can contain the same configuration of parts, or can contain nothing at all and thus be free of any magnetic effect.

The common part 12 is attracted by the part 13 for closing the housing, and is attracted by the part 11 for opening the housing. Said part is thus attracted in turn by the two parts 13, 11 contained in the base 2.

To prevent any magnetic interference and define the attraction forces according to the positions of the plate 3, it is advantageous to provide different materials for the three parts 11, 12, 13. More specifically, given that the force required to open the housing is greater than the force required to close the housing, the two parts 11 and 12 will preferably be magnets which have a large power of attraction towards one another. Since the closing requires less force, the part 13 will be made of metal or ferromagnetic material, and will consist for example of a metal plate. Thus, the part 12 will generally be less attracted by the part 13 than the part 11, and this will facilitate the opening whilst assisting in the closing.

Figure 11:
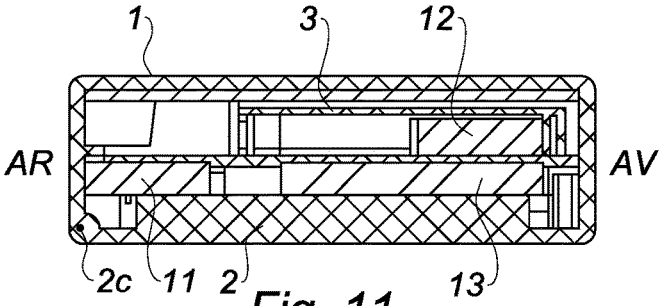
FIG. 11 is a sectional view of the closed housing in the region of the second side thereof and according to the second configuration of the invention.

The parts 11, 12 13 are shown more clearly in FIG. 11. The parts are relatively thin plates which are arranged vertically, in the direction of the length thereof, along the lateral sides of the housings, and fixed in recesses which are provided for this purpose. The parts 9 and 10 also consist of plates of the same type.

With regard to the above description, the optimum dimensional relationships for the portions from the invention, including variations in size, materials, shapes, function and modes of operation, assembly and use, are considered clear and obvious to a person skilled in the art, and all the relationships equivalent to those shown in the drawings and those described in the description are intended to be included in the present invention.

Having thus described the invention of the present application in detail and by reference to embodiments thereof, it will be apparent that modifications and variations are possible without departing from the scope of the invention defined in the appended claims as follows:

I claim:

1. A housing for cosmetic product, comprising:

a base receiving at least one cosmetic product;

a cover mounted on the base so as to be able to rotate, and being movable between a position for closing the housing, which is referred to as the closed position, and a position for opening the housing, which is referred to as the open position;

an intermediate plate receiving at least one cosmetic product, wherein the intermediate plate is mounted on the cover so as to be able to rotate and is arranged between the base and the cover, said intermediate plate being movable between a retracted position, in which said intermediate plate covers the base when the cover is closed, and a deployed position, in which said intermediate plate is set back relative to the base when the cover is open so as to make the cosmetic product at least partially accessible from the base, the intermediate plate passing from the retracted position thereof to the deployed position thereof by a manipulation of the cover, the intermediate plate also being movable in rotation between said deployed position and a release position in which said intermediate plate is led to a distance from the base so as to expose and/or make accessible the entire surface area of the base, wherein the intermediate plate is not in contact with any portion of the base in said release position, and means both for assisting in opening the cover and holding the cover in the open position and also for assisting in closing the cover and holding the cover in the closed position, the means for assisting comprising magnetic devices wherein each of the magnetic devices comprises at least a first part which is attached to the base and at least a second part which is attached to the intermediate plate, said first and second parts cooperating magnetically with one another according to the position of the intermediate plate relative to the base, wherein the base and the intermediate plate each have a rear portion which is located in the vicinity of an axis of rotation of the cover and an axis of rotation of the intermediate plate, as well as a front portion which is located opposite the rear portion, and wherein the magnetic device for assisting in opening the cover and holding the cover in the open position comprises the first part arranged in the rear portion of the base in the region of a first lateral side of the housing and the second part arranged in the front portion of the intermediate plate in the region of the same first lateral side of the housing, the two parts being arranged so as to be superimposed one on top of the other in the open position of the cover, the magnetic device for assisting in closing the cover and holding the cover in the closed position comprises the first part arranged in the front portion of the base in the region of the first lateral side of the housing and the second part which is arranged in the front portion of the intermediate plate in the region of the same first lateral side of the housing, the two parts being arranged so as to be superimposed one on top of the other in the closed position of the cover, wherein the second part of the magnetic device for assisting in closing the cover and holding it in the closed position is coincident with the second part of the magnetic device for assisting in opening the cover and holding it in the open position.

2. The housing according to claim 1, wherein, for each of the magnetic devices, at least one of said first and second parts is made of magnetic material.

3. The housing according to claim 2, wherein, for each of the magnetic devices, said first and second parts are arranged on the same lateral side of the housing which is oriented perpendicularly to an axis of rotation of the cover and an axis of rotation of the intermediate plate.

4. The housing according to the claim 1, wherein for each of the magnetic devices, said first and second parts consist of two magnets exerting a magnetic attraction force on one another.

5. The housing according to claim 1, wherein for each of the magnetic devices, the first part consists of a metal plate and the second part consists of a magnet exerting a magnetic attraction force on said metal plate.

* * * * *